US010941719B2

(12) United States Patent
Fukui et al.

(10) Patent No.: US 10,941,719 B2
(45) Date of Patent: Mar. 9, 2021

(54) EVAPORATIVE FUEL TREATING APPARATUS

(71) Applicants: TOYOTA JIDOSHA KABUSHIKI KAISHA, Toyota (JP); AISAN KOGYO KABUSHIKI KAISHA, Obu (JP)

(72) Inventors: Keita Fukui, Fujinomiya (JP); Makoto Yamazaki, Gotenba (JP); Makoto Takano, Suntoh-gun (JP); Tomohiro Itoh, Susono (JP); Yoshikazu Miyabe, Obu (JP)

(73) Assignees: TOYOTA JIDOSHA KABUSHIKI KAISHA, Toyota (JP); AISAN KOGYO KABUSHIKI KAISHA, Obu (JP)

( * ) Notice: Subject to any disclaimer, the term of this patent is extended or adjusted under 35 U.S.C. 154(b) by 64 days.

(21) Appl. No.: 16/279,761

(22) Filed: Feb. 19, 2019

(65) Prior Publication Data

US 2019/0301380 A1 Oct. 3, 2019

(30) Foreign Application Priority Data

Apr. 3, 2018 (JP) ..... JP2018-071690

(51) Int. Cl.
*F02D 41/00* (2006.01)
*F02M 55/00* (2006.01)
*F02M 25/08* (2006.01)

(52) U.S. Cl.
CPC ..... *F02D 41/0042* (2013.01); *F02M 25/0836* (2013.01); *F02M 55/007* (2013.01)

(58) Field of Classification Search
CPC ..... F02D 41/0042; F02M 25/0836; F02M 55/007
See application file for complete search history.

(56) References Cited

U.S. PATENT DOCUMENTS 5,284,121 A * 2/1994 Abe ..... F02M 25/0836 123/198 D
7,334,559 B2 * 2/2008 Osanai ..... F02D 41/0032 123/198 D (Continued)

FOREIGN PATENT DOCUMENTS

JP 2004-156496 A 6/2004
JP 2014-077422 A 5/2014

(Continued)

*Primary Examiner* — David Hamaoui
*Assistant Examiner* — John D Bailey
(74) *Attorney, Agent, or Firm* — Oliff PLC

(57) ABSTRACT

An evaporative fuel treating apparatus includes: a canister; a vapor passage configured to cause a fuel tank to communicate with the canister; a closure valve including a valve disc arranged in the vapor passage and a stepping motor configured to open and close the valve disc; and a control device configured to control the closure valve. The control device is configured, in opening the valve disc to perform a pressure relief operation of the fuel tank, to: execute a flow rate estimation processing that calculates an estimated flow rate of gas passing through the closure valve, based on the absolute value of the amount of change of in-tank pressure of the fuel tank and a space volume inside the fuel tank; and execute a motor control processing that controls the number of steps of the stepping motor such that the estimated flow rate approaches a required flow rate.

3 Claims, 5 Drawing Sheets

(56) References Cited

U.S. PATENT DOCUMENTS

| | | | | |
|---|---|---|---|---|
| 9,556,029 | B2 * | 1/2017 | Hurst | F25J 1/0017 |
| 2006/0037588 | A1 * | 2/2006 | Osanai | F02D 41/0032 123/520 |
| 2007/0239330 | A1 * | 10/2007 | Baumann | F02M 25/0818 701/33.7 |
| 2009/0019943 | A1 * | 1/2009 | Ozawa | G01F 1/50 73/861 |
| 2011/0203554 | A1 * | 8/2011 | Horiba | F02D 41/221 123/520 |
| 2011/0265768 | A1 * | 11/2011 | Kerns | F02M 25/089 123/521 |
| 2014/0102420 | A1 * | 4/2014 | Kimoto | F02M 25/0836 123/520 |
| 2015/0159566 | A1 * | 6/2015 | Akita | F02D 41/1402 137/488 |
| 2015/0377416 | A1 * | 12/2015 | Miyoshi | G05D 7/0635 141/95 |
| 2016/0230681 | A1 * | 8/2016 | Tanaka | F02D 41/045 |
| 2016/0237926 | A1 * | 8/2016 | Tanaka | F02D 41/0235 |
| 2017/0167413 | A1 | 6/2017 | Tagawa et al. | |
| 2018/0171894 | A1 | 6/2018 | Fukui et al. | |

FOREIGN PATENT DOCUMENTS

| | | | |
|---|---|---|---|
| JP | 2017-110529 | A | 6/2017 |
| JP | 2018-100646 | A | 6/2018 |

* cited by examiner

AA: Fully-open position
BB: Valve opening position
CC: Control origin position

BB: Valve opening position
CC: Control origin position

EVAPORATIVE FUEL TREATING APPARATUS

CROSS-REFERENCE TO RELATED APPLICATION

This application is based on and claims the benefit of Japanese Patent Application No. 2018-071690, filed on Apr. 3, 2018, which is incorporated by reference herein in its entirety.

BACKGROUND

Technical Field

The present disclosure relates to an evaporative fuel treating apparatus, and more particularly to an evaporative fuel treating apparatus provided with a stepping motor type closure valve arranged in a vapor passage that connects a canister and a fuel tank.

Background Art

For example, JP 2014-077422 A discloses an evaporative fuel treating apparatus provided with a stepping motor type closure valve arranged in a vapor passage that connects a canister and a fuel tank. In this evaporative fuel treating apparatus, a pressure relief operation of the fuel tank is performed by opening the closure valve during execution of a purge operation to desorb, from the canister, an evaporative fuel adsorbed in the canister. The stroke of a valve disc of the closure valve is controlled in order to adjust the amount of opening of the closure valve, whereby this pressure relief operation is performed while reducing the effects to the air-fuel ratio of an internal combustion engine.

Moreover, in the evaporative fuel treating apparatus described above, the amount of opening of the closure valve during execution of the pressure relief operation is corrected in accordance with the in-tank pressure of a fuel tank. More specifically, JP 2014-077422 A discloses that, the higher in-tank pressure at the time of opening of the closure valve is, the higher the flow velocity of gas (including evaporative fuel) that flows out from the fuel tank becomes, and thus, the amount of outflow of the gas per unit time becomes greater. Based on this knowledge, according to the evaporative fuel treating apparatus described above, in order to reduce fluctuation of the air-fuel ratio, the amount of opening of the closure valve is corrected so as to be smaller with a higher in-tank pressure.

SUMMARY

According to the JP 2014-077422 A, a relationship between the in-tank pressure and the amount of opening of the closure valve is obtained in advance based on experiments or simulations, and the obtained relationship is stored in an ROM of an electronic control unit (ECU) as a map. Also, according to the evaporative fuel treating apparatus described above, the amount of opening of the stepping motor type closure valve is determined using this map.

However, even when the in-tank pressure and the amount of closing of the closure valve are both constant, the flow rate of gas (including evaporative fuel) that passes through the closure valve changes due to, for example, a variation between closure valves of the same type or the aging of the closure valve. Because of this, according to the manner using the map described above, a situation in which the flow rate of the gas passing through the closure valve cannot be properly controlled may arise.

The present disclosure has been made to address the problem described above, and an object of the present disclosure is to provide an evaporative fuel treating apparatus including a stepping motor type closure valve arranged in a vapor passage that connects a canister with a fuel tank, which can properly control the flow rate of gas that passes through the closure valve when performing a pressure relief operation of the fuel tank.

An evaporative fuel treating apparatus according to the present disclosure includes: a canister configured to adsorb evaporative fuel produced in a fuel tank; a vapor passage configured to cause the fuel tank to communicate with the canister; a closure valve including a valve disc arranged in the vapor passage and a stepping motor configured to open and close the valve disc; and a control device configured to control the closure valve. The control device is configured, in opening the valve disc to perform a pressure relief operation of the fuel tank, to: execute a flow rate estimation processing that calculates an estimated flow rate of gas flowing out from the fuel tank and passing through the closure valve, based on an absolute value of an amount of change of in-tank pressure of the fuel tank and a space volume inside the fuel tank; and execute a motor control processing that controls number of steps of the stepping motor such that the estimated flow rate approaches a required flow rate.

The pressure relief operation may be performed during execution of a purge operation for introducing, into an intake air passage of an internal combustion engine, a purge gas including the evaporative fuel that has desorbed from the canister. Also, the required flow rate used in the motor control processing when the pressure relief operation is performed during execution of the purge operation may be a required purge gas flow rate used in the purge operation.

The control device may be configured, in the motor control processing, to: control, when a flow rate difference obtained by subtracting the estimated flow rate from the required flow rate is greater than or equal to a positive threshold value, the number of steps such that the stepping motor rotates in a direction of opening of the valve disc; and hold the number of steps at a current value when the flow rate difference is greater than or equal to zero and smaller than the threshold value.

The control device may be configured, in the motor control processing, to control, when the flow rate difference is smaller than zero, the number of steps such that the stepping motor rotates in a direction of closing of the valve disc.

According to the evaporative fuel treating apparatus of the present disclosure, in performing the pressure relief operation of the fuel tank, the estimated flow rate of gas passing through the closure valve is calculated based on the amount of change of the in-tank pressure and the space volume inside the fuel tank (flow rate estimation processing). Thus, the flow rate of the gas described above can be estimated without the need of grasping the amount of opening of the valve disc (i.e., the lift amount thereof). Also, according to the evaporative fuel treating apparatus of the present disclosure, the number of steps of the stepping motor is controlled such that the estimated flow rate approaches the required flow rate (motor control processing). Thus, the flow rate of the gas passing through the closure valve can be properly controlled when the pressure relief operation is performed.

DETAILED DESCRIPTION

In the following, embodiments of the present disclosure will be described with reference to the accompanying drawings. However, it is to be understood that even when the number, quantity, amount, range or other numerical attribute of an element is mentioned in the following description of the embodiments, the present disclosure is not limited to the mentioned numerical attribute unless explicitly described otherwise, or unless the present disclosure is explicitly specified by the numerical attribute theoretically. Furthermore, structures or steps or the like that are described in conjunction with the following embodiments are not necessarily essential to the present disclosure unless explicitly shown otherwise, or unless the present disclosure is explicitly specified by the structures, steps or the like theoretically.

1. Hardware Configuration of Evaporative Fuel Treating Apparatus

1-1. Overall Configuration

Figure 1:
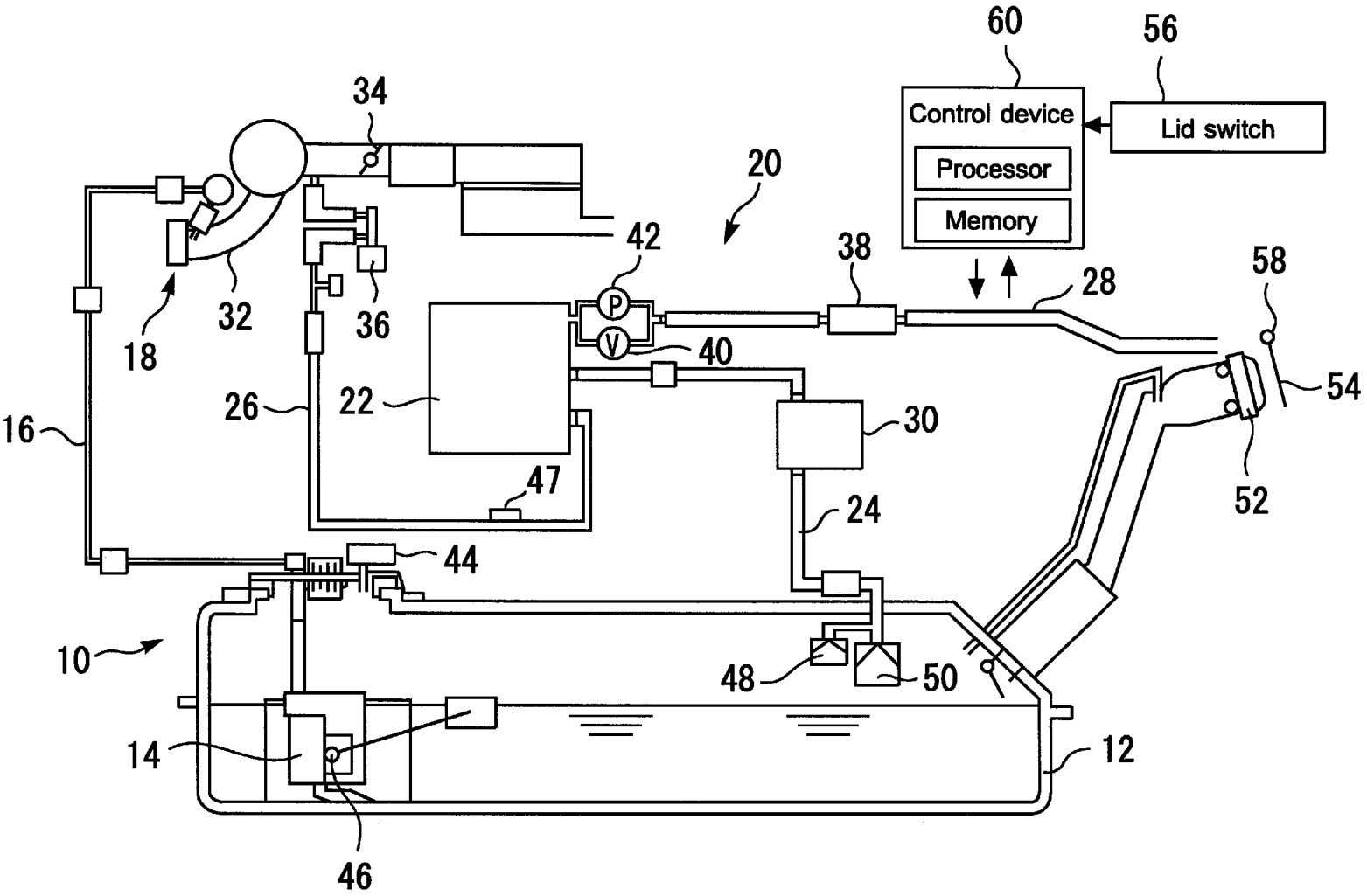
FIG. 1 is a schematic diagram for describing an overall configuration of an evaporative fuel treating apparatus according to an embodiment of the present disclosure.

FIG. 1 is a schematic diagram for describing an overall configuration of an evaporative fuel treating apparatus 20 according to an embodiment of the present disclosure. The evaporative fuel treating apparatus 20 shown in FIG. 1 is applied to a fuel system 10 of a vehicle (not shown). The fuel system 10 is provided with a fuel tank 12 that stores fuel. In the fuel tank 12, a fuel pump 14 is installed. The fuel pumped by the fuel pump 14 is supplied, via a fuel pipe 16, to an internal combustion engine 18 mounted on the vehicle. In addition, it is supposed that the vehicle is provided with an electric motor (not shown) as its power sources in addition to the internal combustion engine 18, and is a hybrid vehicle that can stop the internal combustion engine 18 during running.

The evaporative fuel treating apparatus 20 corresponds to a device for not causing evaporative fuel produced in the fuel tank 12 to be leaked outside (into the atmospheric air). The evaporative fuel treating apparatus 20 is provided with a canister 22, a vapor passage 24, a purge passage 26 and an atmospheric air passage 28. The canister 22 is configured to be able to adsorb the evaporative fuel produced in the fuel tank 12 with an adsorbent (activated charcoal) that is filled therein. One end of the vapor passage 24 communicates with a gas layer in the fuel tank 12, and the remaining end of the vapor passage 24 communicates with the canister 22. The vapor passage 24 is provided with a closure valve 30 that can open and close the vapor passage 24 (more specifically, that can switch between the communication and shut-off of the vapor passage 24). The detailed configuration of the closure valve 30 will be described later with reference to FIG. 2.

One end of the purge passage 26 communicates with the canister 22, and the remaining end of the purge passage 26 communicates with a portion that is included in an intake air passage 32 of the internal combustion engine 18 and that is located on the downstream side of a throttle valve 34. In the purge passage 26, a purge valve 36 that can open and close the purge passage 26 is installed. One end of the atmospheric air passage 28 communicates with the canister 22, and the remaining end of the atmospheric air passage 28 communicates with the atmospheric air. In the atmospheric air passage 28, an air filter 38 is installed. The atmospheric air passage 28 is provided with a switching valve 40 and a pump 42, which are arranged in parallel at a portion closer to the canister 22 relative to the air filter 38, in parallel to. The switching valve 40 can open and close the atmospheric air passage 28 and is configured as, for example, a normal-open type electromagnetic valve that opens at a non-energization time. The pump 42 is configured to be able to pump the atmospheric air toward the canister 22.

An in-tank pressure sensor 44 that outputs a signal responsive to an in-tank pressure P is attached to the fuel tank 12. Also, a float type liquid level sensor 46 for detecting a liquid level position of the fuel is installed inside the fuel tank 12. By the use of the liquid level sensor 46, the remaining fuel level in the fuel tank 12 can be grasped. Moreover, a system pressure sensor 47 that outputs a signal responsive to the pressure at the side of the canister 22 (i.e., at the downstream side of the closure valve 30) is installed at a portion of the purge passage 26 located on the side closer to the canister 22 relative to the purge valve 36.

Furthermore, a cut-off valve 48 that opens and closes due to the buoyancy in the fuel is attached to one of a two-pronged inlet of the vapor passage 24 that opens in the fuel tank 12, and an ORVR valve (Onboard Refueling Vapor Recovery Valve) 50 is attached to the other of the two-pronged inlet. The cut-off valve 48 is normally held in an open state, and closes at the time of rollover of the vehicle to prevent the outflow of the fuel into the vapor passage 24. The ORVR valve 50 is basically configured to open when the fuel tank 12 is not filled with the fuel, and close to shut the vapor passage 24 when the fuel tank 12 is filled with the fuel due to refueling.

The vehicle is equipped with a fuel lid 54 that covers a filler opening 52, a lid switch 56 operated by a user of the vehicle when refueling, and a lid actuator 58 that actuates so as to open the fuel lid 54 (i.e., to release the lock of the fuel lid 54).

The evaporative fuel treating apparatus 20 shown in FIG. 1 includes a control device 60 for controlling each device of the evaporative fuel treating apparatus 20 including the closure valve 30. The control device 60 is an electronic control unit (ECU) that includes at least one processor, at least one memory, and an input/output interface. The input/output interface receives sensor signals from various sensors mounted on the evaporative fuel treating apparatus 20, and also outputs actuating signals to various actuators for controlling the evaporative fuel treating apparatus 20. The various sensors described above include the in-tank pressure sensor 44, the liquid level sensor 46 and the system pressure sensor 47 that are described above. Also, the control device 60 receives a signal from the lid switch 56. The various actuators described above include the closure valve 30 (stepping motor 64 described later), the purge valve 36, the switching valve 40 and the pump 42 that are described above.

In the memory of the control device 60, various programs and various data (including maps) for controlling the evaporative fuel treating apparatus 20 are stored. The processor executes a program stored in the memory. As a result, various functions of the control device 60 are achieved. For example, a gas flow rate control by the operation of the closure valve 30 is one of the functions achieved as a result of a program being executed. It should be noted that the control device 60 may alternatively be configured with a plurality of ECUs.

1-2. Configuration of Closure Valve

Figure 2:
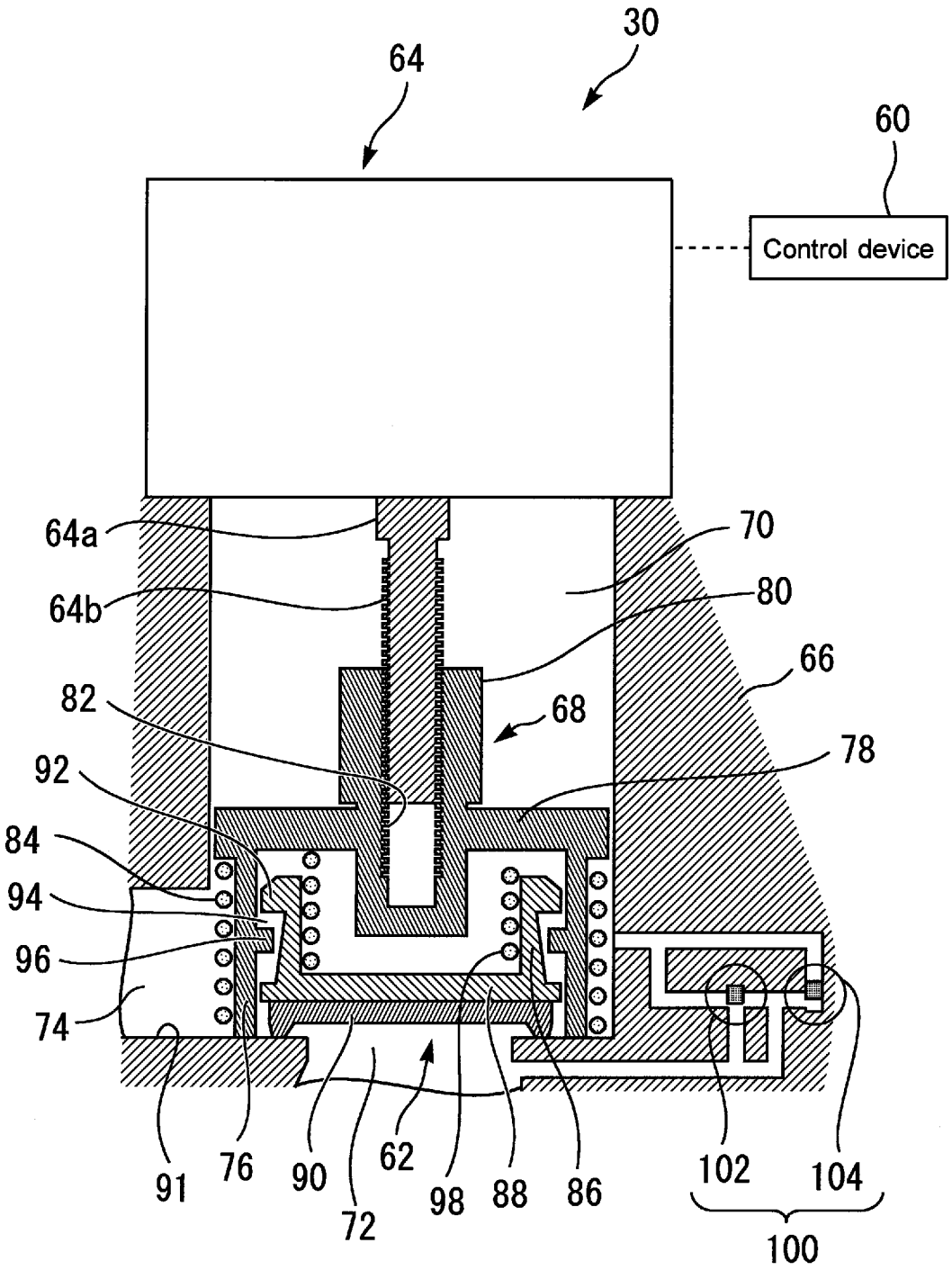
FIG. 2 is a cross-sectional view that illustrates the configuration of a closure valve shown in FIG. 1.

FIG. 2 is a cross-sectional view that illustrates the configuration of the closure valve 30 shown in FIG. 1. The closure valve 30 is a stepping motor type, and includes a valve disc 62 arranged in the vapor passage 24 and a stepping motor (hereunder, abbreviated as an "STM") 64 that opens and closes the valve disc 62. In more detail, as shown in FIG. 2, the closure valve 30 is equipped with a valve casing 66 and a valve guide 68 in addition to the valve disc 62 and the STM 64.

A valve chamber 70, a valve inlet portion 72 and a valve outlet portion 74 are formed inside the valve casing 66. The valve inlet portion 72 and valve outlet portion 74 respectively correspond to the inlet and outlet of a flow passage in the valve chamber 70. The valve chamber 70, the valve inlet portion 72 and the valve outlet portion 74 serve as a part of the vapor passage 24.

The STM 64 is attached to the valve casing 66. An output shaft 64*a* of the STM 64 protrudes in the valve chamber 70 so as to extend toward the side of the valve inlet portion 72. An opening of the valve chamber 70 located on the side opposed to the valve inlet portion 72 is blocked by the STM 64. The output shaft 64*a* is arranged concentrically in the valve chamber 70 of the valve casing 66, and on an outer peripheral surface of the output shaft 64*a*, a male screw portion 64*b* is formed.

The valve guide 68 is formed in a ceiled cylindrical shape by a cylindrical wall portion 76 and an upper wall portion 78 that closes an upper-end open portion of the cylindrical wall portion 76. At the center portion of the upper wall portion 78, a cylindrical shaft portion 80 is formed concentrically with the output shaft 64*a*. A female screw portion 82 is formed on an inner peripheral surface of the cylindrical shaft portion 80. The valve guide 68 is arranged to be able to move in the axial direction (i.e., top-bottom direction in FIG. 2), while the valve guide 68 is prevented by an anti-rotation mechanism (not shown) from rotating around the axial direction with respect to the valve casing 66.

The male screw portion 64*b* of the output shaft 64*a* of the STM 64 is screwed to the female screw portion 82 of the cylindrical shaft portion 80 of the valve guide 68. Thus, as a result of positive rotation and negative rotation of the output shaft 64*a* of the STM 64, the valve guide 68 can reciprocate in the axial direction thereof. An assist spring 84 that biases the valve guide 68 upward is arranged in the vicinity of the valve guide 68.

The valve disc 62 is formed in a ceiled cylindrical shape by a cylindrical wall portion 86 and a lower wall portion 88 that closes a lower-end opening portion of the cylindrical wall portion 86. The valve disc 62 is equipped with a seal portion 90 fixed at a lower surface of the lower wall portion 88. The seal portion 90 is configured by, for example, a disk-shaped elastic member (for example, gum). The valve disc 62 is arranged concentrically in the valve guide 68. The seal portion 90 of the valve disc 62 is arranged so as to be able to come in contact with an upper surface of a valve seat 91 of the valve casing 66 (i.e., with a wall surface of the valve casing 66 formed so as to be opposed to the valve disc 62 and the valve guide 68 at the side of the valve inlet portion 72).

A plurality of connected convex portions 92 arranged in the circumferential direction is formed on an upper-end outer peripheral surface of the cylindrical wall portion 86 of the valve disc 62, and grooved connected concave portions 94 are formed on an inner peripheral surface of the cylindrical wall portion 76 of the valve guide 68. The connected convex portions 92 are engaged with the connected concave portions 94 in such a manner as to be able to relatively move, by a predetermined length, in the axial direction of the output shaft 64*a* (i.e., top-bottom direction of FIG. 2). While bottom wall portions 96 of the connected concave portions 94 of the valve guide 68 are in contact with the connected convex portions 92 of the valve disc 62 from the lower side, the valve guide 68 and the valve disc 62 are integrally movable to the upper side (i.e., to the direction of opening of the valve disc 62). A valve spring 98 that biases the valve disc 62 with respect to the valve guide 68 always to the lower side (i.e., to the direction of closing of the valve disc 62) is concentrically arranged between the upper wall portion 78 of the valve guide 68 and the lower wall portion 88 of the valve disc 62.

It should be noted that the closure valve 30 is provided with a pressure relief device 100. The pressure relief device 100 includes a positive pressure relief valve 102 and a negative pressure relief valve 104, and causes the fuel tank 12 and the vapor passage 24 to communicate with each other without depending on the opening/closing of the closure valve 30 under a situation described below. In detail, when the in-tank pressure P becomes higher than or equal to a positive predetermined pressure, the positive pressure relief valve 102 opens due to a pressure difference between the in-tank pressure P and the pressure at the outlet side of the closure valve 30 (which is pressure of the vapor passage 24 at the side of the canister 22, and is typically the atmospheric air pressure). As a result, the in-tank pressure P is released through the vapor passage 24. The negative pressure relief valve 104 opens due to a pressure difference when the in-tank pressure P is lower than or equal to a negative predetermined value. As a result, the fuel tank 12 is prevented from being put in an excessively negative pressure state.

1-3. Base Operation of Closure Valve

Next, the base operation of the closure valve 30 configured as described above will be described. The control device 60 controls the number of steps of the STM 64 and can thereby rotationally drive the STM 64 in the positive rotational direction or the negative rotational direction thereof. When the STM 64 rotates, by a predetermined number of steps, in the positive rotational direction or the negative rotational direction thereof, the valve guide 68 moves, by a predetermine stroke amount, in the top-down direction of FIG. 2 (i.e., in the direction of opening and closing of the valve disc 62) by the effects of screwing between the male screw portion 64*b* of the output shaft 64*a* and the female screw portion 82 of the cylindrical shaft portion 80 of the valve guide 68.

In the initial state of the valve guide 68 (i.e., in the state shown in FIG. 2), the valve guide 68 is held at the lower limit position thereof, and the lower end surface of the cylindrical wall portion 76 is in contact with the upper surface of the valve seat 91 of the valve casing 66. Moreover, in this state, the connected convex portions 92 of the valve disc 62 are located on the upper side of the bottom wall portions 96 of the connected concave portions 94 of the valve guide 68, and the seal member 90 of the valve disc 62 is pressed to the upper surface of the valve seat 91 of the valve casing 66 by the spring force of the valve spring 98.

It is supposed herein that, when the STM 64 positively rotates, the closure valve 30 (valve disc 62) operates in the direction of opening thereof, and, when, on the other hand, the STM 64 negatively rotates, the closure valve 30 (valve disc 62) operates in the direction of closing thereof. When the STM 64 rotates in the positive rotational direction (i.e., in the direction of opening) from the above-described initial state of the valve guide 68, the valve guide 68 moves upward by the effects of screwing between the male screw portion 64*b* and the female screw portion 82, and the bottom wall portions 96 of the connected concave portions 94 of the valve guide 68 are in contact with the connected convex portions 92 of the valve disc 62 from the lower side. Also, when the STM 64 rotates further to the direction of opening thereof and the valve guide 68 moves further upward, the valve disc 62 moves upward in synchronization with the valve guide 68 and the seal portion 90 of the valve disc 62 moves away from the valve seat 91 of the valve casing 66. That is to say, the valve disc 62 (closure valve 30) opens. As a result, flow passages (i.e., valve chamber 70, valve inlet portion 72 and valve outlet portion 74) corresponding to a part of the vapor passage 24 are caused to communicate with each other.

2. Control of Evaporative Fuel Treating Apparatus

2-1. Purge Operation

According to the evaporative fuel treating apparatus 20 described above, the evaporative fuel produced in the fuel tank 12 flows into the canister 22 through the vapor passage 24 and is adsorbed by (an adsorbent of) the canister 22. When a predetermined purge condition is met during operation of the internal combustion engine 18, the control device 60 executes a "purge operation" for desorbing, from the canister 22, the evaporative fuel adsorbed in the canister 22. In detail, the purge valve 36 is opened during execution of the purge operation. As described above, the switching valve 40 is basically open. Because of this, in response to opening of the purge valve 36, the atmospheric air flows into the canister 22 from the atmospheric air passage 28 by the effects of intake negative pressure of the internal combustion engine 18. This atmospheric air desorbs the evaporative fuel from the canister 22, and a purge gas including the desorbed evaporative fuel (i.e., fuel components) is introduced into the intake air passage 32.

2-2. Issue of Pressure Relief Operation of Fuel Tank by Opening of Closure Valve As a premise, according to the evaporative fuel treating apparatus 20 equipped with the closure valve 30 in the vapor passage 24, a "sealed tank system" that can seal the evaporative fuel in the fuel tank 12 can be achieved by causing the closure valve 30 to be put into a closed state. In, for example, a vehicle that is hard to obtain the opportunity of execution of the purge operation due to the fact that the operation of an internal combustion engine is stopped during running of the vehicle as in a hybrid vehicle supposed in the present embodiment, this kind of sealed tank system is favorable to the reduction of the inflow of the evaporative fuel into a canister (i.e., the reduction of adsorption of the evaporative fuel into the canister) from a fuel tank in intended situations.

On that basis, the control device 60 executes a "pressure relief operation" that decreases the in-tank pressure P by opening the closure valve 30 (in more detail, by releasing the seal portion 90 of the valve disc 62 from valve seat 91 of the valve casing 66) when the in-tank pressure P is high. Typical examples of situations of performing this kind of pressure relief operation are the time of the purge operation being performed during running of the vehicle and the time of refueling. More specifically, the pressure relief operation is executed in association with execution of the purge operation when the in-tank pressure P becomes higher than a predetermined threshold value THp during running of the vehicle. In addition, if the lid switch 56 is pushed by a user for refueling, in order to reduce the outflow of the evaporative fuel from the filler opening 52, it is required to promptly reduce the in-tank pressure P before the filler opening 52 is opened. Because of this, the pressure relief operation is also required at the time of refueling.

To be more specific, where the pressure relief operation is performed by opening the closure valve 30 in the evaporative fuel treating apparatus 20 having a function as a the sealed tank system described above, it is required to note the following points. That is to say, first, it is required to perform the pressure relief operation at the time of execution of the purge operation during running of the vehicle while adjusting the opening degree of the closure valve 30 (valve disc 62) such that a "closure-valve passing-through gas flow rate" becomes lower than or equal to a "purge gas flow rate". This is because, if the closure-valve passing-through gas flow rate is higher than the purge gas flow rate, the amount of adsorption of the evaporative fuel into the canister 22 becomes greater than the amount of desorption of the evaporative fuel from the canister 22, and the function as the sealed tank system cannot be properly maintained. It should be noted that the closure-valve passing-through gas flow rate (hereunder, also abbreviated as a "closure-valve flow rate") mentioned here refers to a flow rate of gas that passes through the closure valve 30 (i.e., gas (including the evaporative fuel) that flows out from the fuel tank 12), and the purge gas flow rate refers to a flow rate of the purge gas (i.e., gas including the evaporative fuel) adjusted by adjustment of the opening degree of the purge valve 36.

Moreover, it is required that the pressure relief operation at the time of refueling be executed so as to promptly decrease the in-tank pressure P as described above. However, if the in-tank pressure P is decreased by a high closure-valve flow rate that is higher than or equal to a predetermined flow rate, the ORVR valve 50 is closed (i.e., the vapor passage 24 is shut) and, as a result, the in-tank pressure P may not be decreased.

In order to favorably satisfy the requirements at the time of execution of the purge operation and the time of refueling as described so far, it is important to be able to properly control the closure-valve flow rate during execution of the pressure relief operation. Also, the importance of this kind of flow rate control becomes higher when a stepping motor type closure valve is used similarly to the closure valve 30 according to the present embodiment. The reason is as follows.

That is to say, according to the closure valve 30 having the structure as shown in FIG. 2, the valve disc 62 is not immediately opened by only rotating the STM 64, by one step in the direction of opening (i.e., positive rotational direction), from the state of the valve disc 62 being seated on the valve seat 91 as well as the valve guide 68 (i.e., from the state shown in FIG. 2). In order to open the valve disc 62 (i.e., to release the seal portion 90 of the valve disc 62 from the valve seat 91), it is required to rotate the STM 64 from the state described above by a certain number of steps. Also, the number of steps when the valve disc 62 starts to open is different due to, for example, a variation between closure valves 30 of the same type, and is also different due to the aging of the closure valve 30. Thus, even if the number of steps of the closure valve 30 is controlled with a certain number of steps, the actual amount of opening of the valve disc 62 is different due to the reasons, such as above-described variation between closure valves 30 of the same type. According to stepping motor type closure valve 30, a measure to properly control the closure-valve flow rate is required since it is difficult to grasp the actual amount of opening of the valve disc 62 due to, for example, the reasons as described above.

2-3. Outline of Processing Concerning Pressure Relief Operation

According to the present embodiment, in order to enable the pressure relief operation while properly controlling the closure-valve flow rate, the following "flow rate estimation processing" and "motor control processing" are executed. According to the flow rate estimation processing, an "estimated flow rate" Q of the gas that flows out from the fuel tank 12 and passes through the closure valve 30 (i.e., an estimated value of the closure-valve flow rate) is calculated on the basis of the absolute value of change amount ΔP of the in-tank pressure P and a space volume inside the fuel tank 12 (more specifically, the volume of the gas layer in the fuel tank 12) V1. Also, according to the motor control processing, the number of steps of the STM 64 is controlled such that the estimated flow rate Q approaches a "required flow rate" Qt. Specifically, according to the present embodiment, these flow rate estimation processing and motor control processing are executed as described below, as an example.

2-3-1. Detailed Example of Flow Rate Estimation Processing

Calculation of the estimated flow rate Q (L/sec) in the flow rate estimation processing is performed by the use of the following relationship of equation (1). In equation (1), ΔP (kPa) denotes the absolute value of change amount of the in-tank pressure P during a predetermined time interval Δt (sec), and Pa denotes the atmospheric air pressure (kPa). Equation (2) indicates a relationship obtained when the time interval Δt in equation (1) is one second.

$$Q=(\Delta P\cdot V1)/(Pa\cdot\Delta t) \quad (1)$$

$$Q=(\Delta P\cdot V1)/Pa \quad (2)$$

Here, a way of derivation of equation (1) described above will be described. If the in-tank pressure P at a time point t is referred to as Pt, the state equation of the gas in the fuel tank 12 at the time point t is expressed as shown in equation (3) mentioned below. In equation (3), n denotes the number of molecules of the gas in the fuel tank 12, R denotes a gas constant, and T denotes the temperature of this gas.

$$Pt\cdot V1=nRT \quad (3)$$

P(t+Δt) in equation (4) mentioned below denotes an in-tank pressure P at a time point (t+Δt) at which the time interval Δt from the time point t has elapsed, and n' denotes the number of molecules of the gas in the fuel tank 12 at the time point t (t+Δt). The state equation of the gas in the fuel tank 12 at the time point (t+Δt) is expressed by this equation (4). Also, volume V2 in equation (5) mentioned below denotes the volume of gas that has passed through the closure valve 30 (i.e., gas that has flown into the canister 22 from the fuel tank 12) during the time interval Δt, and n" denotes the number of molecules of this gas. Moreover, the pressure in the vapor passage 24 at the downstream side of the closure valve 30 (i.e., at the side of the canister 22) is the atmospheric air pressure Pa. Thus, the state equation of the gas that has passed through the closure valve 30 during the time interval Δt is expressed by equation (5).

$$P(t+\Delta t)\cdot V1=n'RT \quad (4)$$

$$Pa\cdot V2=n''RT \quad (5)$$

If it is assumed that the gas temperature T during the time interval Δt is constant, the number n of molecules of the gas in the fuel tank 12 at the time point t is expressed as the sum of the number n' of molecules of the gas remained in the fuel tank 12 at the time point (t+Δt) and the number n" of molecules of the gas that has passed through the closure valve 30 during the time interval Δt, as shown in equation (6) mentioned below. Thus, the following equation (7) is derived from equations (3) to (6). When equation (7) is modified, equation (8) mentioned below is derived. Also, the estimated flow rate Q that is an estimation value of the closure-valve flow rate corresponds to a value obtained by dividing, by the time interval Δt, the volume V2 of the gas that passed through the closure valve 30 during the time interval Δt, as shown in equation (9). Thus, equation (1) (and also equation (2)) mentioned above that are calculation equations of the estimated flow rate Q are derived.

$$n=n'+n'' \quad (6)$$

$$Pt\cdot V1=P(t+\Delta t)\cdot V1+Pa\cdot V2 \quad (7)$$

$$V2=(Pt-P(t+\Delta t))-V1/Pa=\Delta P\cdot V1/Pa \quad (8)$$

$$Q=V2/\Delta t=(\Delta P\cdot V1)/Pa/\Delta t \quad (9)$$

According to equation (1) derived as described so far, by obtaining the change amount (more specifically, time change amount) ΔP of the in-tank pressure P and the space volume V1 in the fuel tank 12, the estimated flow rate Q can be calculated without depending on the opening degree of the closure valve 30. It should be noted that, although a fixed value is herein used as the atmospheric air pressure Pa, this atmospheric air pressure Pa, that is, the pressure of the gas at the side of the canister 22 (i.e., at the downstream side of the closure valve 30) may alternatively obtained by the use of the system pressure sensor 47, for example.

To be more specific, the change amount ΔP of the in-tank pressure P can be calculated by the use of a detection value of the in-tank pressure sensor 44, for example. The space volume (i.e., the volume of the gas layer) V1 inside the fuel tank 12 can be calculated from a remaining fuel level in the fuel tank 12 obtained by the use of the liquid level sensor 46, for example. However, calculation of this space volume V1 may alternatively be simplified by using, as a fixed value, a value of the space volume at the time of the fuel tank 12 being empty (i.e., the volume in the fuel tank 12 itself). In addition, although a desired value can be used as the time interval Δt, according to the present embodiment, one second is used as an example of the time interval Δt. Thus, the estimated flow rate Q is calculated by the use of equation (2) simplified as compared to equation (1).

2-3-2. Detailed Example of Motor Control Processing

According to the motor control processing, the control device 60 calculates a "flow rate difference" ΔQ obtained by subtracting the estimated flow rate Q from the required flow rate Qt. Also, when the flow rate difference ΔQ is greater than or equal to a positive threshold value THq, the control device 60 controls the number of steps such that the STM 64 rotates in the direction of opening of the valve disc 62 (i.e., such that the STM 64 rotates in the positive rotational direction). When, on the other hand, the flow rate difference ΔQ is greater than or equal to zero and is smaller than the threshold value THq, the control device 60 holds the number of steps at the current value. In addition, when the flow rate difference ΔQ is smaller than zero, the control device 60 controls the number of steps such that the STM 64 rotates in the direction of closing of the valve disc 62 (i.e., such that the STM 64 rotates in the negative rotational direction).

2-4. Processing of Control Device Concerning Pressure Relief Operation

Figure 3:
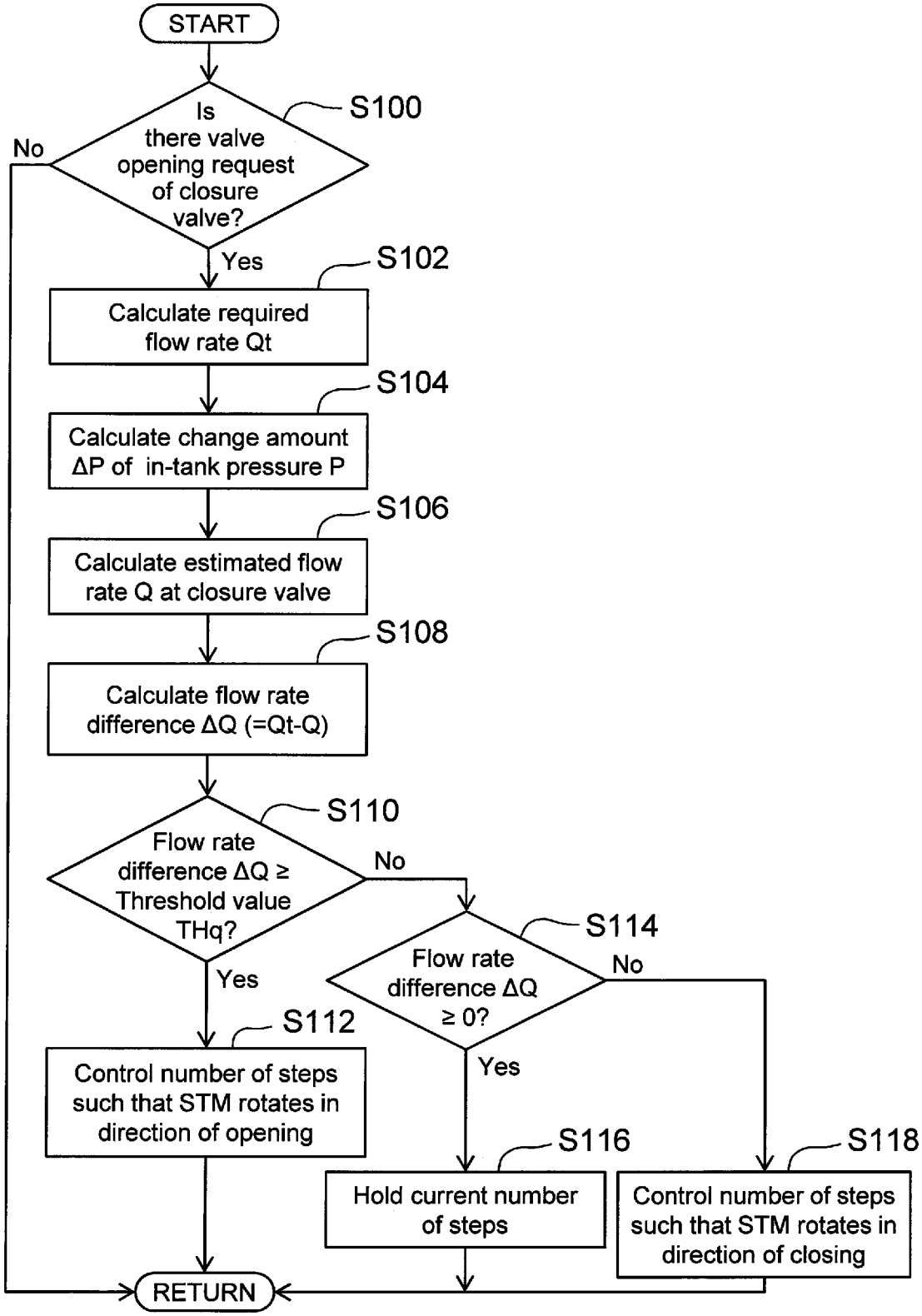
FIG. 3 is a flow chart that illustrates a routine of the processing concerning a pressure relief operation according to the embodiment of the present disclosure.

FIG. 3 is a flow chart that illustrates a routine of the processing concerning the pressure relief operation according to the embodiment of the present disclosure. The control device 60 repeatedly executes the processing according to the present routine at a predetermined control interval.

According to the routine shown in FIG. 3, first, the control device 60 determines whether or not there is a valve opening request of the closure valve 30 (step S100). In detail, at the time of refueling, the control device 60 determines that the valve opening request has been made when the lid switch 56 is pushed by a user. Also, when an execution condition of the purge operation is met and the in-tank pressure P is higher than or equal to the threshold value THp during running of the vehicle, the control device 60 determines that valve opening request has been made.

If the determination result of step S100 is negative, the control device 60 ends the current processing cycle. If, on the other hand, the determination result of step S100 is positive, the processing proceeds to step S102. In step S102, the control device 60 calculates the required flow rate Qt. The required flow rate Qt used at the time of refueling corresponds to, for example, a constant value determined in accordance with the specification of the vehicle. Also, the required flow rate Qt used at the time of execution of the purge operation corresponds to, for example, a required purge gas flow rate which is controlled in the purge operation. It should be noted that the required purge gas flow rate itself is determined in accordance with engine operating conditions, such as intake air flow rate, engine speed and throttle opening degree.

After step S102, the processing proceeds to step S104. In step S104, the control device 60 calculates the change amount ΔQ of the in-tank pressure P. According to the processing of the present routine, one second is used as the time interval Δt described above. Thus, the change amount ΔP calculated in this step S104 is equal to the absolute value of a difference between an in-tank pressure P at the current time point and an in-tank pressure P before one second. The control device 60 calculates the change amount ΔP by subtracting the in-tank pressure P at the current time point detected by the in-tank pressure sensor 44 from a stored value of the in-tank pressure P before one second stored in the memory of the control device 60.

After step S104, the processing proceeds to step S106. In step S106, the control device 60 executes the flow rate estimation processing described above to calculate the estimated flow rate Q at the closure valve 30. In detail, the control device 60 calculates the estimated flow rate Q by substituting the change amount ΔP calculated in step S104 into the equation (2) mentioned above as well as the space volume V1 in the fuel tank 12 and the atmospheric air pressure Pa.

After step S106, the processing proceeds to step S108. In step S108, the control device 60 calculates the flow rate difference ΔQ (=Qt−Q) based on the calculation results of steps S102 and S106.

After step S108, the processing proceeds to step S110. In step S110, the control device 60 determines whether or not the flow rate difference ΔQ is greater than or equal to the threshold value THq described above. In the present embodiment, the predetermined threshold value THq is a positive value and is smaller than the required flow rate Qt. It should be noted that the threshold value THq used at the time of execution of the purge operation may alternatively be different from the threshold value THq used at the time of refueling.

If the determination result of step S110 is positive (ΔQ≥THq), the processing proceeds to step S112. In step S112, the control device 60 controls the number of steps such that the STM 64 (output shaft 64*a*) rotates in the direction of opening (i.e., positive rotational direction) of the closure valve 30 (valve disc 62).

If the determination result of step S110 is negative (ΔQ<THq), the processing proceeds to step S114. In step S114, the control device 60 determines whether or not the flow rate difference ΔQ is higher than or equal to zero. As a result, if this determination result is positive (ΔQ≥0), the processing proceeds to step S116. In step S116, the control device 60 holds the number of steps of the STM 64 at the current value.

If, on the other hand, the determination result of step S114 is negative (ΔQ<0), the processing proceeds to step S118. In step S118, the control device 60 controls the number of steps such that the STM 64 (output shaft 64*a*) rotates in the direction of closing (i.e., negative rotational direction) of the closure valve 30 (valve disc 62).

It should be noted that, according to the routine shown in FIG. 3, the processing of steps S104 and S106 corresponds to an example of the "flow rate estimation processing" according to the present disclosure, and the processing of steps S102, and S108 to S118 corresponds to an example of the "motor control processing" according to the present disclosure.

2-5. Example of Pressure Relief Operation at Refueling

Figure 4:
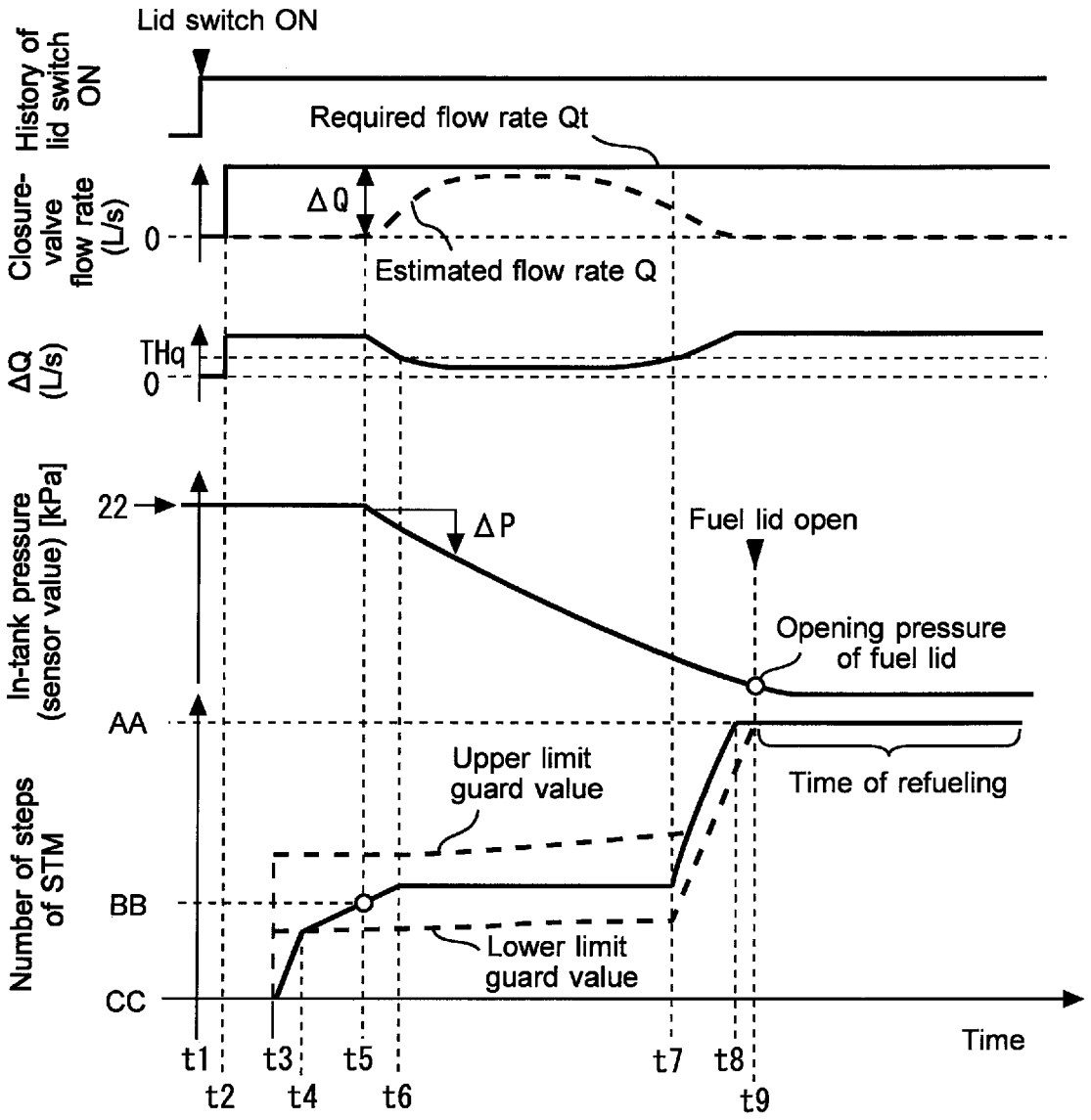
FIG. 4 is a time chart for describing an example of the pressure relief operation at the time of refueling according to the processing of a routine shown in FIG. 3.

FIG. 4 is a time chart for describing an example of the pressure relief operation at the time of refueling according to the processing of the routine shown in FIG. 3. A "control origin position" of the number of steps of the STM 64 in FIG. 4 corresponds to the number of steps obtained when the STM 64 is in the state shown in FIG. 2 (i.e., in the state of the valve guide 68 as well as the valve disc 62 being seated on the valve seat 91). In addition, the amount of rotation (i.e., rotational angle) of the STM 64 that adjusts the amount of stroke of the valve guide 68 is controlled step by step. A "valve opening position" in FIG. 4 corresponds to the number of steps of the STM 64 associated with the amount of stroke of the valve guide 68 obtained when the seal portion 90 of the valve disc 62 moves away from the valve seat 91.

A time point t1 in FIG. 1 corresponds to a time point at which the lid switch 56 is pushed by a user (i.e., a time point at which a valve opening request of the closure valve 30 has been made). A time point t2 corresponds to a time point at which calculation of the estimated flow rate Q by the flow rate estimation processing and calculation of the flow rate difference ΔQ by the motor control processing are started thereafter. A time point t3 corresponds to a time point at which rotation of the STM 64 is started thereafter. A time point t4 corresponds to a time point at which the number of steps is reached to a lower limit guard value after the start of the rotation of the STM 64. A time point t5 corresponds to a time point at which the valve disc 62 starts to open thereafter (i.e., a time point at which the valve opening position is reached).

In a time period from the time point t2 to the time point t5, although the valve opening request has already been made, the closure valve 30 has not yet been opened (i.e., the valve disc 62 is not away from the valve seat 91). Because of this, when the flow rate estimation processing is performed during this time period (t2-t5), the estimated flow rate Q also becomes zero since the change amount ΔP of the in-tank pressure P becomes zero. As a result, the flow rate difference ΔQ becomes equal to the required flow rate Qt. In addition, according to the routine shown in FIG. 3, during this time period (t2-t5), the determination result of step S110 becomes positive (ΔQ≥THq) and the number of steps of the STM 64 is controlled such that the STM 64 rotates in the direction of opening (in the example shown in FIG. 4, the number of steps is increased). Because of this, according to the processing of the present routine, after the valve opening request is made, the STM 64 is controlled such that the closure valve 30 opens.

In addition, the lower limit guard value shown in FIG. 4 corresponds to the number of steps at which it is guaranteed that the valve disc 62 is not away from the valve seat 91 under the number of steps that is lower than or equal to the lower limit guard value, provided that a predetermined initializing processing of the STM 64 has already been executed. Meanwhile, in order for a user to be able to start refueling as soon as possible, it is favorable that the pressure relief operation at the refueling is completed as short as possible in time. Accordingly, with respect to a time period (t3-t4) from the start of the rotation of the STM 64 until the number of steps being reached to the lower limit guard value, the STM 64 may alternatively be controlled so as to rotate as fast as possible, as in the example shown in FIG. 4.

After the valve disc 62 starts to open at the time point t5, the in-tank pressure P decreases, and the estimated flow rate Q also becomes higher than zero since the absolute value of the change amount ΔP becomes greater than zero. To be more specific, the estimated flow rate Q becomes higher in proportion to the absolute value of the change amount ΔP. As a result, the flow rate difference ΔQ also becomes smaller than the required flow rate Qt. According to the processing of the routine shown in FIG. 3, while the flow rate ΔQ is greater than or equal to the threshold value THq, the number of steps is increased and the opening degree of the valve disc 62 is continuously increased (step S112). Also, according to the example shown in FIG. 4, the control of the number of steps in this situation is performed while limiting the number of steps such that it does not exceed the upper limit guard value. This is because, even if the difference between the estimated flow rate Q and the actual flow rate becomes greater, the actual flow rate is not caused to excessively increase. It should be noted that the upper limit guard value changes in accordance with the in-tank pressure P and becomes greater in association with a decrease of the in-tank pressure P.

A time point t6 corresponds to a time point at which the flow rate difference ΔQ falls below the threshold value THq as a result of the flow rate difference ΔQ becoming smaller in association with an increase of the estimated flow rate Q. According to the processing of the routine shown in FIG. 3, as a result of this time point t6 being reached, the number of steps is held at the current value (i.e., at the value at the time point t6) (step S116). As a result, the opening degree of the valve disc 62 is held at the current value (i.e., at the value at the time point t6).

As shown in FIG. 4, even after the opening degree of the valve disc 62 is held at the time point t6, the in-tank pressure P is continuously decreased with a lapse of time. According to the example shown in FIG. 4, after the elapse of the time point t6, the absolute value of the change amount ΔP is properly maintained high, and the estimated flow rate Q is properly closer to the required flow rate Qt (in other words, the flow rate difference ΔQ is properly maintained between the threshold value THq and zero). Thereafter, if, as a result of a decrease of the in-tank pressure P, the absolute value of the change amount ΔP becomes smaller, the estimated flow rate Q becomes smaller and the flow rate difference ΔQ starts to increase in response thereto.

A time point t7 corresponds to a time point at which the flow rate difference ΔQ exceeds the threshold value THq. In response to arrival of this time point t7, according to the processing of the routine shown in FIG. 3, the number of steps of the STM 64 is increased again such that the opening degree of the valve disc 62 increases (step S112).

In addition, after the time point t7 at which the in-tank pressure P has sufficiently decreased, in order to complete the pressure relief operation as soon as possible, the STM 64 may alternatively be controlled so as to rotate as fast as possible, as in the example shown in FIG. 4. It should be noted that, according to the example shown in FIG. 4, the number of steps is increased so as to follow the upper limit guard value that becomes greater in association with a decrease of the in-tank pressure P.

A time point t8 corresponds to a time point at which the number of steps of the STM 64 is reached to a "fully-open position" (i.e., a value at which the maximum opening degree of the valve disc 62 is obtained). Thereafter, the number of steps is held at this fully-open position. A time point t9 corresponds to a time point at which the in-tank pressure P is decreased to a predetermined opening pressure of the fuel lid 54 after the time point t8. At this time point t9, the control device 60 opens the fuel lid 54 by the use of the lid actuator 58 (i.e., releases the lock of the fuel lid 54). As a result, a user of the vehicle can open the filler opening 52 to perform refueling.

When the user closes the fuel lid 54 after the refueling is completed, the lid switch 56 is turned OFF, and the valve opening request of the closure valve 30 is eliminated. As a result, according to the routine shown in FIG. 3, the determination result of step S100 becomes negative, and the pressure relief operation at the time of the refueling is ended. It should be noted that, after the end of the pressure relief operation, the control device 60 controls (i.e., decreases) the number of steps such that the closure valve 30 closes (more specifically, such that the number of steps returns to the control origin position).

Figure 5:
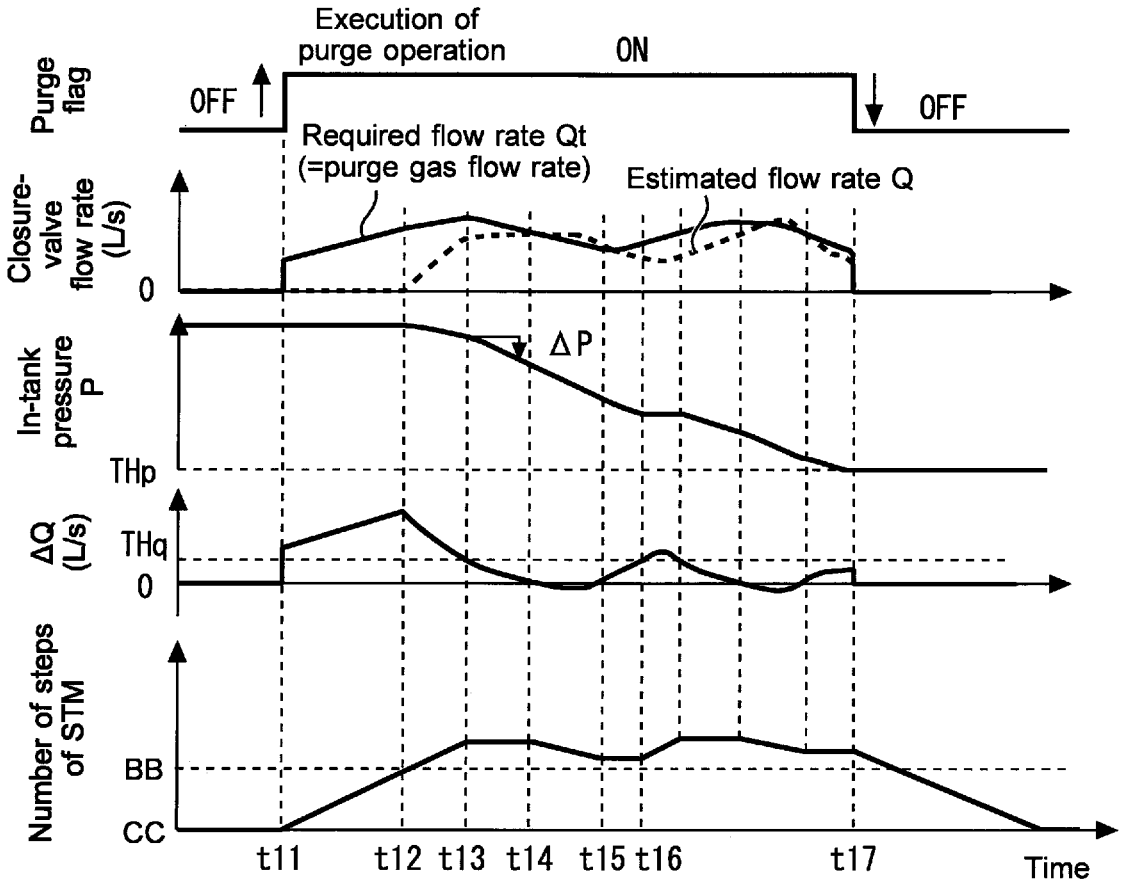
FIG. 5 is a time chart for describing an example of the pressure relief operation at the time of execution of a purge operation according to the processing of the routine shown in FIG. 3.

2-6. Example of Pressure Relief Operation at Time of Execution of Purge Operation FIG. 5 is a time chart for describing an example of the pressure relief operation at the time of execution of the purge operation according to the processing of the routine shown in FIG. 3. A time point t11 in FIG. 5 corresponds to a time point at which the in-tank pressure P is higher than or equal to the threshold value THp and a purge flag is turned ON from OFF (i.e., a time point at which a predetermined purge condition for performing the purge operation is met).

As already described, the required flow rate Qt is set to a value equal to the purge gas flow rate according to the engine operating conditions. According to the processing of the routine shown in FIG. 3, after the time point t11 is reached, an increase of the number of steps of the STM 64 is immediately started in order to open the closure valve 30 since the determination result of step S110 becomes positive (ΔQ≥THq) (step S112).

A time point t12 corresponds to a time point at which the valve disc 62 starts to open (i.e., a time point at which the valve opening position is reached). According to the example shown in FIG. 5, with respect to a time period from the time point t11 to the time point t12, the estimated flow rate Q is zero since the valve disc 62 is not open, and, on the other hand, the required flow rate Qt becomes higher in association with an increase of the purge gas flow rate. Because of this, the flow rate difference ΔQ becomes greater.

On the other hand, after the valve disc 62 starts to open at the time point t12, the estimated flow rate Q becomes higher than zero. As a result, the flow rate difference ΔQ fluctuates in accordance with increase and decrease of the estimated flow rate Q and the required flow rate Qt. A time point t13 corresponds to a time point at which the flow rate difference ΔQ falls below the threshold value THq. According to the processing of the routine shown in FIG. 3, in response to this time point t13 being reached, the number of steps (i.e., the opening degree of the valve disc 62) is heled at the current value (step S116).

Moreover, according to the example shown in FIG. 5, at a time point t14 thereafter, the flow rate difference ΔQ falls below zero. According to the processing of the routine shown in FIG. 3, after this time point t14 is reached, while the flow rate difference ΔQ is smaller than zero, the number of steps is decreased and the opening degree of the valve disc 62 thus becomes smaller. When, thereafter, the flow rate difference ΔQ increases again to zero at a time point t15, the number of steps (i.e., the opening degree of the valve disc 62) is held again at the current value. Also, when the flow rate difference ΔQ increases again to the threshold value THq at a time point t16 thereafter, the number of steps (i.e., the opening degree of the valve disc 62) is increased again. According to the example shown in FIG. 5, thereafter, the number of steps (i.e., the opening degree of the valve disc 62) is also slightly adjusted in accordance with a relationship between the flow rate difference ΔQ and the two threshold values (THq and zero).

According to the processing of the routine shown in FIG. 3, the number of steps of the STM 64 can be controlled also during execution of the purge operation shown in FIG. 5, such that the estimated flow rate Q approaches the required flow rate Qt. Also, in the course of the number of steps being controlled in this way, the in-tank pressure P is continuously decreased as shown in FIG. 5.

Moreover, a time point t17 corresponds to a time point at which the purge flag is turned OFF (i.e., a time point at which the valve opening request of the closure valve 30 is eliminated). When the time point t17 is reached, the purge operation is ended and the pressure relief operation is also ended. Because of this, as shown in FIG. 5, after the elapse of the time point t17, the control device 60 controls (i.e., decreases) the number of steps such that the closure valve 30 closes (more specifically, such that the number of steps returns to the control origin position).

It should be noted that, according to the example shown in FIG. 5, the in-tank pressure P is favorably decreased to around the threshold value THp near the time point t17 at which the purge operation is ended. Contrary to this kind of example, when the in-tank pressure P decreases to be lower than the threshold value THp during execution of the purge operation, the valve opening request is eliminated due to this change of the in-tank pressure P, and the pressure relief operation is thus ended (i.e., the closure valve 30 is closed).

3. Advantageous Effects

As described so far, according to the present embodiment, when the pressure relief operation is performed, the estimated flow rate Q of the gas that passes through the closure valve 30 is calculated on the basis of the change amount ΔP of the in-tank pressure P and the space volume V1 in the fuel tank 12 (flow rate estimation processing). Because of this, the closure-valve flow rate can be estimated without the need of grasping the amount of opening of the valve disc 62 (i.e., the lift amount thereof). In more detail, even if, for example, under a condition that each of the in-tank pressure P and the amount of opening of the valve disc 62 is constant, the closure-valve flow rate changes due to a variation of the closure valve 30 (i.e., variation between closure valves 30 of the same type) or the aging of the closure valve 30, the flow rate estimation processing can properly estimate the closure-valve flow rate without being affected by this kind of change.

Also, according to the present embodiment, the number of steps of the STM 64 is controlled (i.e., feedback-controlled) such that the estimated flow rate Q calculated by the flow rate estimation processing described above approaches the required flow rate Qt (motor control processing). Because of this, the closure-valve flow rate can be properly controlled when the pressure relief operation is performed.

Moreover, the flow rate estimation processing of the present embodiment also has advantageous effects that the estimated flow rate Q can be calculated by the use of information from the already existing in-tank pressure sensor 44 for the fuel system 10 of the vehicle (i.e., without the need of additionally including a dedicated sensor). It should be noted that, according to the example of calculating the space volume V1 inside the fuel tank 12 based on the remaining fuel level, the estimated flow rate Q can be calculated by the use of, as well as the in-tank pressure sensor 44, the already existing liquid level sensor 46 similarly for the fuel system 10.

Moreover, according to the flow rate estimation processing of the present embodiment, when the pressure relief operation is performed during execution of the purge operation, a value equal to the required purge gas flow rate is used as the required flow rate Qt. As a result, the closure-valve flow rate can be properly controlled such that the closure-valve flow rate does not greatly exceed the purge gas flow rate.

Furthermore, according to the motor control processing of the present embodiment, the processing to control (i.e., increase) the number of steps such that the STM 64 rotates in the direction of opening of the valve disc 62 (step S112) is executed when the flow rate difference ΔQ is not zero but is greater than or equal to the positive threshold value THq (i.e., the threshold value THq greater than zero). As a result, as compared to when zero is used as the threshold value for determining whether or not the processing proceeds to step S112, a time period during which the processing to increase the opening degree of the valve disc 62 (step S112) is executed is shortened, or the opportunity of this processing being executed is reduced. Therefore, especially at the initial stage of the pressure relief operation in which the in-tank pressure P is high, it can be favorably achieved that the actual closure-valve flow rate is prevented from being excessively increased due to the fact that the opening degree of the valve disc 62 is excessively opened.

4. Another Example of Execution of Pressure Relief Operation

In the embodiment described above, the pressure relief operation by opening the closure valve 30 is executed at the time of execution of the purge operation during running of the vehicle and the time of refueling. However, the pressure relief operation associated with the "flow rate estimation processing" and "motor control processing" according to the present disclosure is not limited to the example of execution described above (i.e., the time of execution of the purge operation and the time of refueling), and may alternatively be executed under another situation in which it is required to open the closure valve 30 while adjusting the closure-valve flow rate. The "another situation" mentioned here corresponds to, for example, a time at which the closure valve 30 is forcibly driven in order to perform fault diagnosis of the closure valve 30. Specifically, in an example of this kind of forcibly driving, where the control device 60 receives a valve opening request of the closure valve 30 that has been made from a device for performing the fault diagnosis described above, the flow rate estimation processing and the motor control processing are executed, for example, similarly to the time of refueling described above.

What is claimed is:

1. An evaporative fuel treating apparatus, comprising:

a canister configured to adsorb evaporative fuel produced in a fuel tank;

a vapor passage configured to cause the fuel tank to communicate with the canister;

a closure valve including a valve disc arranged in the vapor passage and a stepping motor configured to open and close the valve disc; and a control device configured to control the closure valve, wherein the control device is configured, in opening the valve disc to perform a pressure relief operation of the fuel tank, to:

execute a flow rate estimation processing that calculates an estimated flow rate of gas flowing out from the fuel tank and passing through the closure valve, based on an absolute value of an amount of change of in-tank pressure of the fuel tank and a space volume inside the fuel tank; and execute a motor control processing that controls number of steps of the stepping motor such that the estimated flow rate approaches a required flow rate; and wherein the control device is configured, in the motor control processing, to:

control, when a flow rate difference obtained by subtracting the estimated flow rate from the required flow rate is greater than or equal to a positive threshold value, the number of steps such that the stepping motor rotates in a direction of opening of the valve disc; and hold the number of steps at a current value when the flow rate difference is greater than or equal to zero and smaller than the threshold value.

2. The evaporative fuel treating apparatus according to claim 1, wherein the pressure relief operation is performed during execution of a purge operation for introducing, into an intake air passage of an internal combustion engine, a purge gas including the evaporative fuel that has desorbed from the canister, and wherein the required flow rate used in the motor control processing when the pressure relief operation is performed during execution of the purge operation is a required purge gas flow rate used in the purge operation.

3. The evaporative fuel treating apparatus according to claim 1, wherein the control device is configured, in the motor control processing, to control, when the flow rate difference is smaller than zero, the number of steps such that the stepping motor rotates in a direction of closing of the valve disc.

* * * * *